US011850658B2

(12) United States Patent
Mochizuki

(10) Patent No.: US 11,850,658 B2
(45) Date of Patent: Dec. 26, 2023

(54) MOLTEN METAL FURNACE

(71) Applicant: TOUNETSU CO., LTD., Shizuoka (JP)

(72) Inventor: Kiyata Mochizuki, Shizuoka (JP)

(73) Assignee: TOUNETSU CO., LTD., Shizuoka (JP)

( * ) Notice: Subject to any disclaimer, the term of this patent is extended or adjusted under 35 U.S.C. 154(b) by 64 days.

(21) Appl. No.: 17/774,679

(22) PCT Filed: Apr. 6, 2020

(86) PCT No.: PCT/JP2020/015511
§ 371 (c)(1),
(2) Date: May 5, 2022

(87) PCT Pub. No.: WO2021/186749
PCT Pub. Date: Sep. 23, 2021

(65) Prior Publication Data

US 2023/0063418 A1 Mar. 2, 2023

(30) Foreign Application Priority Data

Mar. 18, 2020 (JP) ..... 2020-047554

(51) Int. Cl.
*B22D 41/02* (2006.01)

(52) U.S. Cl.
CPC ..... *B22D 41/02* (2013.01)

(58) Field of Classification Search
CPC ..... B22D 41/02; F27D 1/0003; F27D 1/0009
See application file for complete search history.

(56) References Cited

U.S. PATENT DOCUMENTS 4,449,221 A * 5/1984 Keller ..... F27D 9/00 373/44
2018/0124877 A1 5/2018 Mochizuki

FOREIGN PATENT DOCUMENTS

| | | | |
|---|---|---|---|
| CN | 207674950 U | * | 7/2018 |
| JP | 4-329340 | | 11/1992 |
| JP | 2004-058136 | | 2/2004 |
| JP | 2013-44510 | | 3/2013 |
| JP | 2017-194236 | | 10/2017 |
| JP | 2019-20049 | | 2/2019 |
| JP | 6644776 | | 2/2020 |

OTHER PUBLICATIONS

International Search Report for PCT/JP2020/015511, dated Jun. 23, 2020.

* cited by examiner

*Primary Examiner* — Scott R Kastler
(74) *Attorney, Agent, or Firm* — ANDRUS INTELLECTUAL PROPERTY LAW

(57) ABSTRACT

A molten metal furnace capable of preventing or suppressing the molten metal leakage and controlling the leakage direction. A molten metal furnace including an outer wall in an outer peripheral portion and a molten metal storage part holding a molten metal, in which a plurality of lining material layers are arranged on an inner wall of the molten metal furnace forming the molten metal storage part; of the lining material layers, a first lining layer constituting a surface in contact with the molten metal is made of a refractory material; and a sealing material is provided on at least one boundary between the first lining layer and the outer wall.

3 Claims, 8 Drawing Sheets

[FIG.1]
PRIOR ART
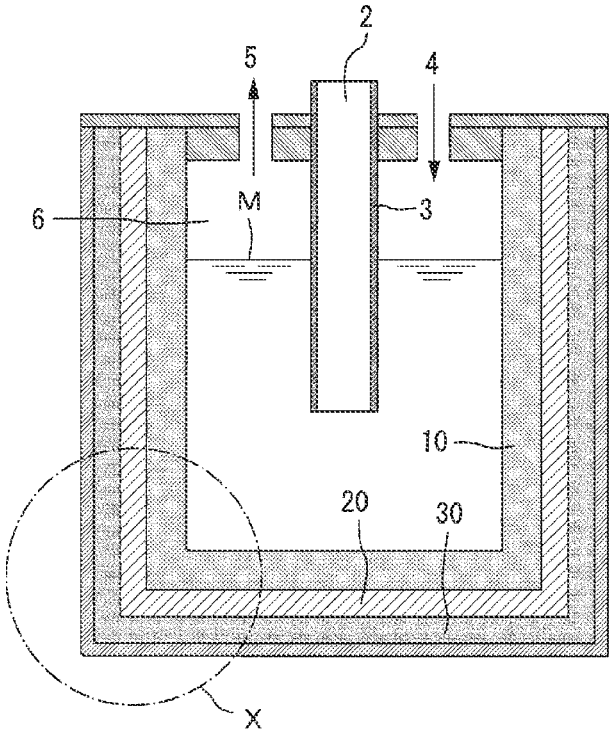

[FIG.2]
PRIOR ART
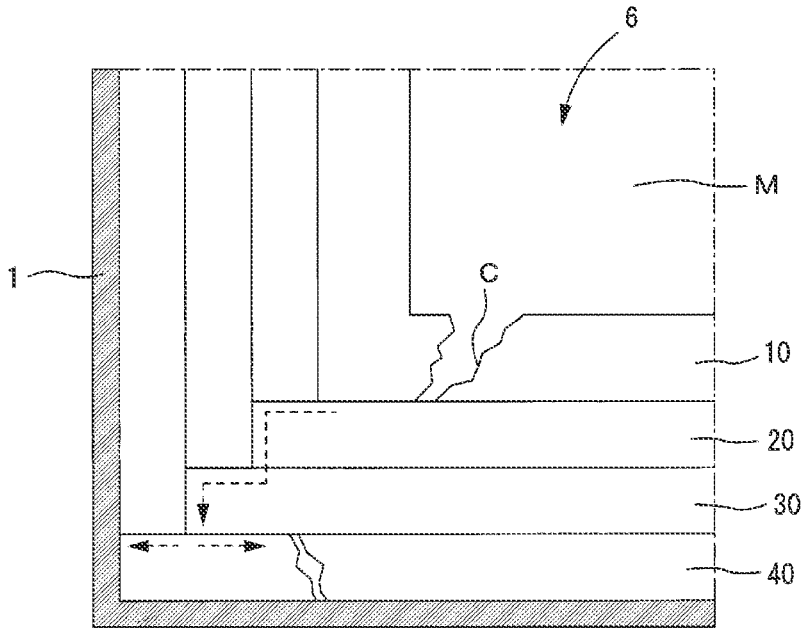

[FIG.3]
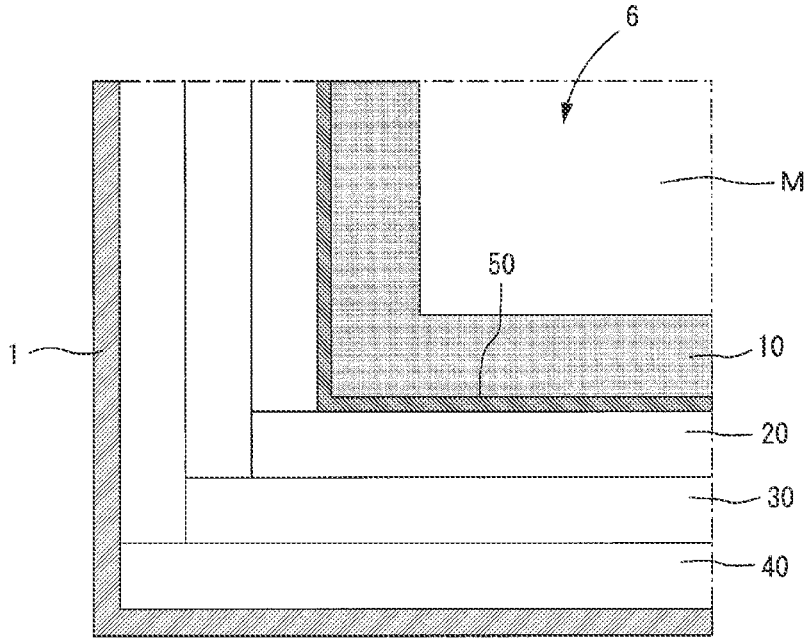

[FIG.4]
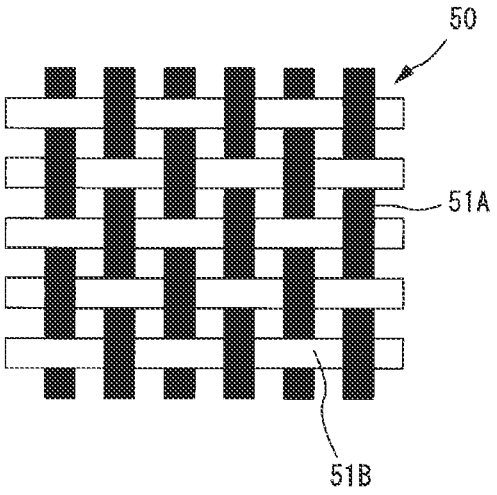
[FIG.5]
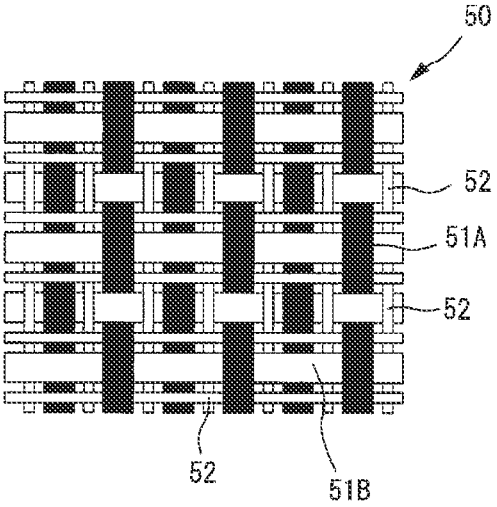

[FIG.6]
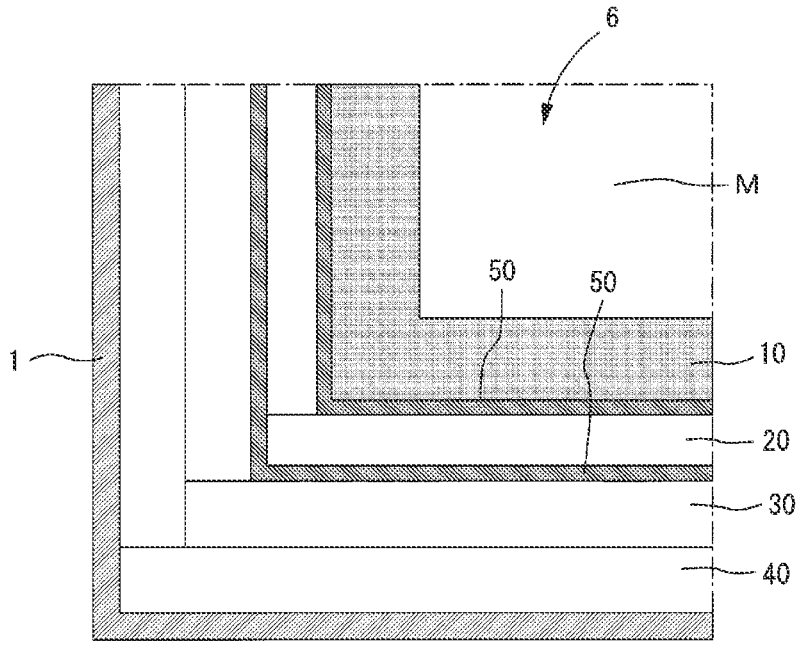

[FIG.7]
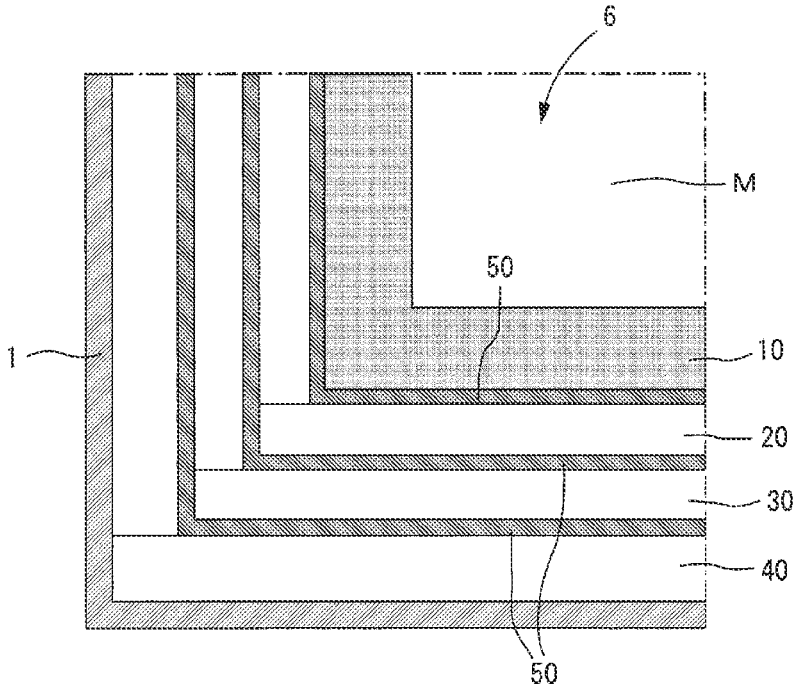

[FIG.8]
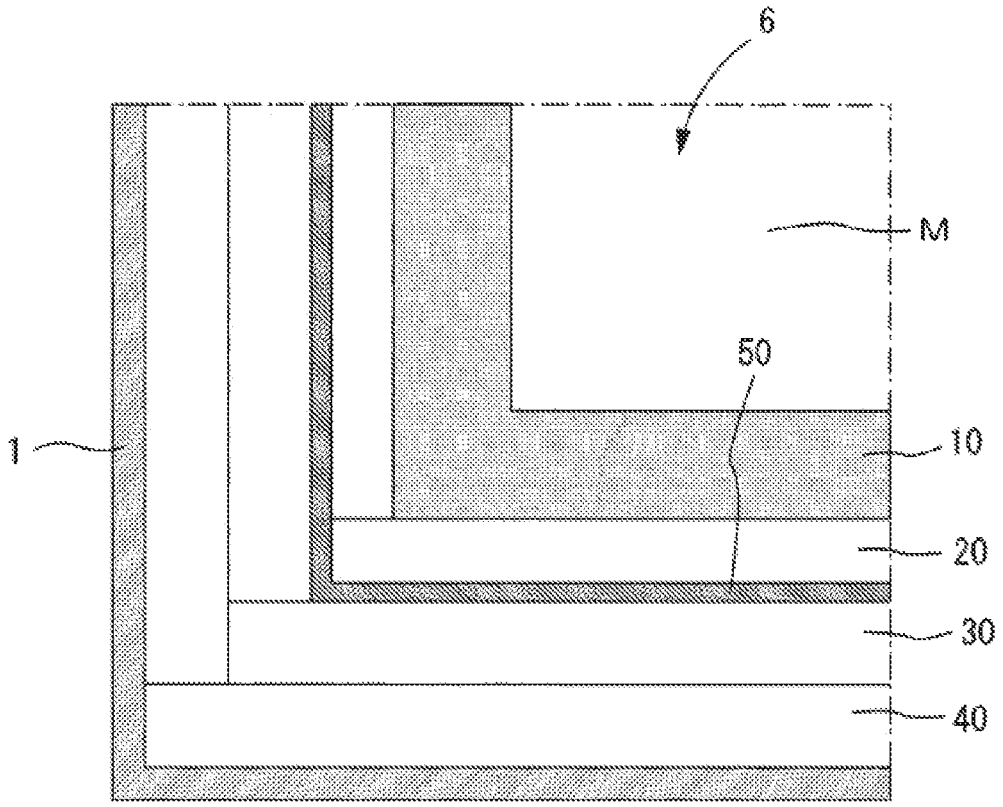

[FIG.9]
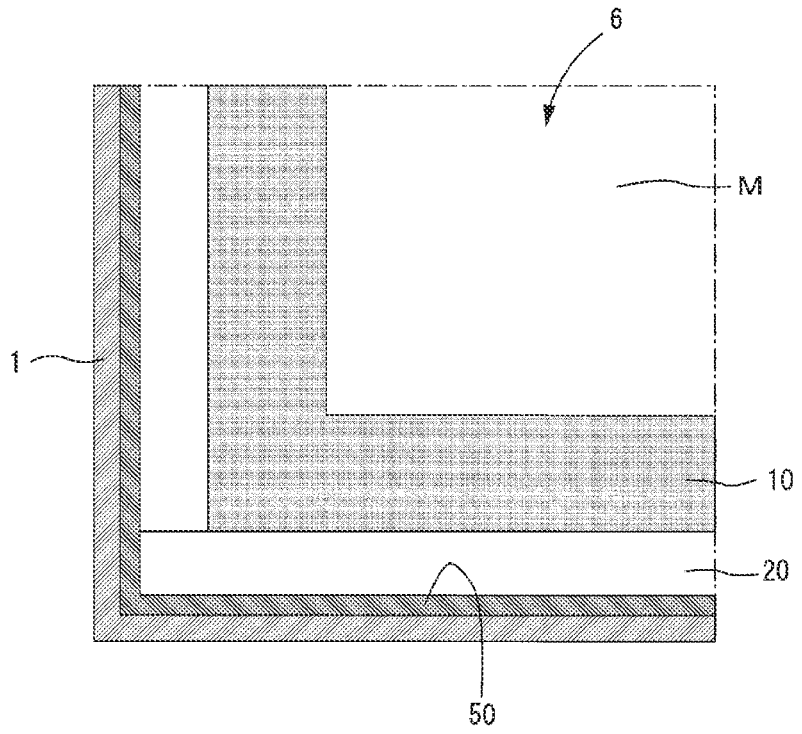

MOLTEN METAL FURNACE

CROSS-REFERENCE TO RELATED APPLICATIONS

This application is the U.S. national stage application of International Application PCT/JP2020/015511, filed Apr. 6, 2020, which international application was published on Sep. 23, 2021, as International Publication WO 2021/186749 in the Japanese language. The International Application claims priority of Japanese Patent Application No. 2020-047554, filed Mar. 18, 2020. The international application and Japanese application are both incorporated herein by reference, in entirety.

TECHNICAL FIELD

The present invention relates to a molten metal furnace for holding molten metals such as aluminum, aluminum alloys, and non-ferrous metals.

BACKGROUND ART

Conventionally, there is a melting and holding furnace that melts and holds molten metals such as aluminum, aluminum alloys, and non-ferrous metals (see, for example, Patent Literature 1). A furnace body of a general melting and holding furnace includes a bottom wall and a peripheral wall or a side wall extending in the vertical direction from the peripheral end of the bottom wall. The bottom wall and the side wall basically include lining materials such as an iron outer wall (iron skin), a heat insulating layer, a backup layer, and a refractory layer (hereinafter, also referred to as "refractory" or "refractory material") in order from the outside to the inside, thus forming a molten metal storage part for holding the molten metal inside the refractory layer.

In such a melting and holding furnace, a lining material, particularly, a refractory layer in contact with the molten metal, for example, precast blocks of shaped refractories (fired/non-fired), insulating firebricks, refractory bricks (fired/non-fired/electroformed), and the like, refractory mortars of monolithic refractories (heat-setting, air-setting, and hydraulic), castable refractories (conventionally, low-cement), lightweight castable refractories, and the like are used. The molten metal has a property of easily permeating the structure of these refractory layers and a reducing power.

For example, oxides are generated in the molten aluminum alloy (hereinafter, also referred to as "molten aluminum"), cracks of the furnace body damage tend to occur due to long-term use, and the molten aluminum permeates the cracks in the refractory layer and causes molten metal leakage (also referred to as "melt leakage"). As a result, the molten aluminum leaks to the outside of the molten metal storage part in some cases.

Patent Literature 2 discloses a molten metal leakage detection method for detecting the leakage of molten metal based on a conductive state between a first electrode formed inside the furnace body or the substantially entire outer surface of the furnace body, and a second electrode that is immersed in the molten metal inside the furnace body.

CITATION LIST

Patent Literature

Patent Literature 1: JP 6644776 B
Patent Literature 2: JP 2004-58136 A

SUMMARY OF INVENTION

Technical Problem

However, the method disclosed in Patent Literature 2 detects the result of the molten metal leakage on the assumption that the molten metal leaks, and does not prevent the molten metal leakage. To prevent the molten metal leakage, there is actually a method of dealing with the leakage by using a refractory with a thickness of about 100 mm as a refractory layer. However, when the furnace is used for about 6 to 8 years, damage due to cracks on the furnace body is found in some cases.

In addition, it is difficult to prevent the molten metal leakage to the outside in the case of continuous operation where operation is stopped only two to four times a year for the purpose of maintenance. It is therefore necessary to focus on dealing with disadvantages in terms of operation such as ensuring safety for workers and reducing the amount of heat of the molten metal.

Therefore, an object of the present invention is to provide a molten metal furnace capable of preventing or suppressing molten metal leakage and controlling the leakage direction.

Solution to Problem

An aspect of the means for solving the above problems is as follows.

A molten metal furnace including:

an outer wall in an outer peripheral portion; and a molten metal storage part holding molten metal, in which a plurality of lining material layers are arranged on an inner wall of the molten metal furnace forming the molten metal storage part, of the plurality of lining material layers, a first lining layer constituting a surface in contact with the molten metal is made of a refractory material, and a sealing material is provided on at least one boundary between the first lining layer and the outer wall.

Advantageous Effects of Invention

According to the present invention, the molten metal leakage can be prevented or suppressed, and the leakage direction can be controlled.

BRIEF DESCRIPTION OF DRAWINGS

FIG. 1 is a cross-sectional view of an example of a molten metal furnace.

FIG. 2 is a cross-sectional view for explaining molten metal leakage in a portion X of FIG. 1.

FIG. 3 is a cross-sectional view of an example of arrangement of a sealing material in an embodiment.

FIG. 4 is a rear view of an example of weaving of a sealing material.

FIG. 5 is a rear view of an example of weaving of a sealing material reinforced with reinforcing fibers.

FIG. 6 is a cross-sectional view of an example of arrangement of a sealing material in another embodiment.

FIG. 7 is a cross-sectional view of an example of arrangement of a sealing material in another embodiment.

FIG. 8 is a cross-sectional view of an example of arrangement of a sealing material in still another embodiment.

FIG. 9 is a cross-sectional view of an example of arrangement of a sealing material in a different embodiment.

DESCRIPTION OF EMBODIMENTS

Hereinafter, embodiments of the present invention will be described.

As shown in FIG. 1, a molten metal furnace has an outer wall 1 in an outer peripheral portion and a plurality of lining material layers arranged on an inner wall forming a molten metal storage part 6 to hold a molten metal M.

As shown in FIG. 1, the lining material layer includes, for example, a first lining layer 10, a second lining layer 20, and a third lining layer 30.

The first lining layer 10 constitutes a surface in contact with the molten metal M such as aluminum or an alloy thereof, and is made of a refractory material. As the refractory material, a low cement castable refractory containing alumina ($Al_2O_3$) as a main component is used, for example. As the second lining layer 20 and the third lining layer 30, fibers or castable refractories containing at least one of alumina ($Al_2O_3$) and silica ($SiO_2$) are used, and heat insulation and heat resistance are secured.

As the molten metal furnace, those having various structures can be targeted. A molten metal furnace having the structure shown in FIG. 1 is a molten metal holding furnace for low pressure casting, and the details are as follows.

That is, a tap port 2 is provided in an upper part, and the tap port 2 is composed of a cylindrical stalk 3. In addition, an air supply port 4 and an exhaust port 5 are provided in the upper part, so that pressurized gas can be supplied to and exhausted from the molten metal holding chamber.

A pressurizing device (not shown) feeds a pressurized gas such as dry air or an inert gas such as argon or nitrogen into the molten metal holding chamber through the air supply port 4. The pressurized gas fed into the molten metal holding chamber pressurizes the liquid surface of the molten metal, and the molten metal rises in the stalk 3 and is injected into a cavity formed in a casting mold (not shown) through the tap port 2.

After the completion of casting, the supply of the pressurized gas from the air supply port 4 is stopped, and the pressurized gas in the molten metal holding chamber is exhausted from the exhaust port 5.

In this type of molten metal furnace, as described above and as schematically shown in FIG. 2 (example in the case where the lining layer is composed of four layers), cracks C of the furnace body damage tend to occur due to long-term use, and molten metal such as molten aluminum permeates the cracks in the refractory layer and causes molten metal leakage (also referred to as "melt leakage") in some cases. The outer wall 1 is, for example, an iron outer wall, and in an extreme case, the molten aluminum that has permeated the cracks reaches the outer wall 1 and the outer wall 1 expands outward due to heat of the molten aluminum in some cases. An example of the flow of molten metal leakage is shown by the broken line in FIG. 2.

To solve this problem, as shown in FIG. 3, a sealing material 50 is provided at least between the first lining layer 10 and the second lining layer 20 on the outer wall side.

As the sealing material 50, a sheet-shaped material, particularly, a sheet-shaped material having a thickness of 2 to 10 mm can be preferably used.

The sealing material 50 is particularly preferably a sheet material obtained by weaving at least one of ceramic fibers and biosoluble ceramic fibers and at least one of glass fibers and stainless steel fibers.

The biosoluble ceramic fiber used in the present invention is selected from fibers classified in Category 0 (exempt substances) in the "EU Directive 97/69/EC" regulation. Such a fiber needs to be a fiber whose safety is verified based on Nota Q "criteria for biosoluble fibers" for any of the following four animal experiments, or a fiber in which a numerical value obtained by subtracting a value twice the standard deviation from the length weighted geometric average diameter exceeds 6 μm, based on Nota R "criteria for non-inhalable fibers".

(1) In a bioretention test by short-term inhalation, fibers longer than 20 μm have a load half-life of less than 10 days.

(2) In a bioretention test by short-term intratracheal injection, fibers longer than 20 μm have a load half-life of less than 40 days.

(3) No evidence of excessive carcinogenicity by intraperitoneal administration test.

(4) No relevant pathogenic changes or neoplastic changes in long-term inhalation test.

As long as it is a biosoluble ceramic fiber whose safety has been confirmed as described above, there is no particular limitation on its manufacturing method, chemical composition, average fiber diameter, or average fiber length. For example, biosoluble rock wool can also be used.

Those containing more than 18% by mass of oxides of alkali metals and alkaline earth metals ($Na_2O$, $K_2O$, CaO, MgO, BaO, and the like) can be used.

Silica-magnesia-calcia alkaline earth silicate wool can also be used.

As the ceramic fiber, amorphous refractory ceramic fibers (hereinafter, referred to as "RCF"), which are mainly used at a normal temperature of lower than 1,400° C. and are artificial mineral fibers mainly composed of alumina ($Al_2O_3$) and silica ($SiO_2$), and alumina crystalline ceramic fibers used at temperatures higher than 1,400° C. are known. These RCFs and crystalline ceramic fibers greatly differ in their manufacturing methods, performances, and prices, and they are used properly according to their characteristics.

The temperature of the molten metal, especially aluminum or aluminum alloy, reaches 700° C. or higher. Therefore, it is preferable that at least one of the ceramic fiber and the biosoluble ceramic fiber is reinforced with at least one of the glass fiber and the stainless steel fiber.

In particular, it is desirable to reinforce the ceramic fiber with at least stainless steel fiber from the viewpoint of heat resistance.

In order to form the sealing material 50 is in the form of a sheet, particularly, in the form of a sheet having a thickness of 2 to 10 mm, fiber yarns (fibers or strands) can be woven into a sheet-shape. The weaving may be, for example, plain weave, twill weave, satin weave shown in FIGS. 4 and 5, or an appropriate weaving form.

Then, as shown in FIG. 5, a reinforcing fiber 52 of at least one of the glass fiber and the stainless steel fiber can be woven, in an appropriate form, into the first fibers 51A and 51B of at least one of the ceramic fiber and the biosoluble ceramic fiber. The reinforcing fiber 52 can also be incorporated into the strands for reinforcement. Then, the strand into which reinforcing fibers are incorporated can be woven in an appropriate form to form a sheet-shaped sealing material.

As shown in FIG. 6, the sealing material 50 can also be provided between the second lining layer 20 and the third lining layer 30 on the outer wall 1 side of the second lining layer 20.

Further, as shown in FIG. 7, the sealing material 50 can also be provided between the third lining layer 30 and the fourth lining layer 40 on the outer wall 1 side of the third lining layer 30.

In the present invention, a sealing material may be provided on at least one boundary between the first lining layer 10 and the outer wall 1. For example, as shown in FIG. 8, the sealing layer may also be provided only on the boundary on the outer wall side of the second lining layer 20, that is, the boundary between the second lining layer 20 and the third lining layer 30 on the outer wall 1 side of the second lining layer 20.

Further, for example, as shown in FIG. 9, the sealing material may also be provided only on the boundary between the outermost lining layer (the second lining layer 20 in the example of FIG. 9) and the outer wall 1.

Further, when the sealing material 50 is provided between the lining layers as described above and the molten metal M is first introduced in the molten metal storage part, the heat of the molten metal M is transmitted to the sealing material 50 through the first lining layer 10 to burn the sealing material 50, thus generating a burning odor in some cases. In order to suppress this odor, the sealing material 50 can be fired in advance.

Incidentally, for the molten metal leakage, attention has been paid mainly to the selection of the material for the first lining layer. However, the occurrence of cracks in the first lining layer 10 cannot be avoided, and there is a possibility that cracks will occur, and the risk of molten metal leakage through the cracks still remains.

The present inventor did not pay attention to the selection of the material for the first lining layer 10, but completed the present invention on the assumption that cracks would occur in the first lining layer 10.

Even when the molten metal leaks through the cracks, if the amount of leakage can be minimized, the amount of heat is reduced, and the direction of the leakage can be controlled, thus preventing permeation into the outer wall, prevention of the molten metal leakage to the outer wall, which is the ultimate goal, can be achieved.

The use of the sealing material according to the present invention, in particular, use of the heat-resistant (refractory) sealing material brings the following advantages.

(1) Withstands the temperature of the molten metal (for example, withstands 700° C. in the case of molten aluminum).

(2) Do not contaminate the molten metal in the molten metal storage part.

(3) The amount of heat of the leaked molten metal can be reduced, and the permeation of the leaked molten metal can be suppressed before the molten metal reaches the outer wall.

(4) The direction when the molten metal leaks can be controlled.

Normally, the leaked molten metal descends along between the lining layers due to gravity and then spreads in the horizontal direction when reaching the lining layer horizontally provided on the outer wall side. In some cases, cracks may occur in the lining layer horizontally provided on the outer wall side, and the molten metal leakage may spread due to gravity through the cracks, and therefore the leakage direction is unpredictable.

When the sealing material according to the present invention is provided between the lining layers, the leaked molten metal becomes difficult to descend along between the lining layers due to resistance by the sealing material (that is, the descending speed can be suppressed), and the amount of heat of the molten metal that has leaked is reduced during that time. Thus, it is possible to suppress the permeation of the molten metal that has leaked before the molten metal reaches the lining layer horizontally provided on the outer wall side. Further, since the sealing material is provided, it becomes difficult for the molten metal to come into direct contact with the lining layer on the outer wall side, and thus cracks are less likely to occur.

That is, in the present invention, controlling the direction when the molten metal leaks specifically means narrowing the space between the lining layers with a sealing material to increase the resistance and suppress the speed of the leaked molten metal, and means controlling the permeation to the outer wall side.

INDUSTRIAL APPLICABILITY

The molten metal may be aluminum, aluminum alloys, or other molten metals.

REFERENCE SIGNS LIST

1 Outer wall
10 First lining layer
20 Second lining layer
30 Third lining layer
40 Fourth lining layer
50 Sealing material
M Molten metal

The invention claimed is:

1. A molten metal furnace comprising:
an outer wall in an outer peripheral portion; and
a plurality of lining material layers arranged on an inner surface of the outer wall to form a molten metal storage part holding molten metal,
wherein among the plurality of lining material layers, a first lining layer constituting a surface in contact with the molten metal is made of a refractory material, and
wherein a sealing material is provided on at least one boundary between the first lining layer and the outer wall, the sealing material comprising a sheet material obtained by interweaving fiber yarns comprising at least one of ceramic fibers and biosoluble ceramic fibers, and at least one of glass fibers and stainless steel fibers.

2. The molten metal furnace according to claim 1,
wherein the sealing material has a sheet shape with a thickness of 2 to 10 mm, and is provided in a single layer or a plurality of laminated layers.

3. The molten metal furnace according to claim 1,
wherein the at least one of glass fibers and stainless steel fibers comprise reinforcing fibers that are incorporated into the fiber yarns comprising strands of the at least one of ceramic fibers and biosoluble ceramic fibers.

* * * * *